United States Patent [19]

Richardson

[11] 4,452,677

[45] Jun. 5, 1984

[54] TUNGSTEN-QUARTZ SEALS

[75] Inventor: Donald A. Richardson, Beverly, Mass.

[73] Assignee: GTE Products Corporation, Stamford, Conn.

[21] Appl. No.: 462,836

[22] Filed: Feb. 2, 1983

[51] Int. Cl.[3] ..... C25F 3/08

[52] U.S. Cl. ..... 204/129.1; 204/129.75

[58] Field of Search ..... 204/129.1, 129.75, 146

[56] References Cited

U.S. PATENT DOCUMENTS

| | | | |
|---|---|---|---|
| 2,156,156 | 4/1939 | Mahlck | 204/146 |
| 3,516,874 | 6/1970 | Maker et al. | 204/129.1 |
| 3,753,878 | 8/1973 | Gosger | 204/129.1 |

*Primary Examiner*—Donald R. Valentine

*Attorney, Agent, or Firm*—William H. McNeill

[57] ABSTRACT

Tungsten-to-quartz seals are improved by electrochemically etching drawn, ground tungsten rod until some of the original draw lines appear and then using the so treated rod in the seal formation. The etching is carried out in a solution of $NaNO_2$; NaOH; and $H_2O$.

3 Claims, 1 Drawing Figure

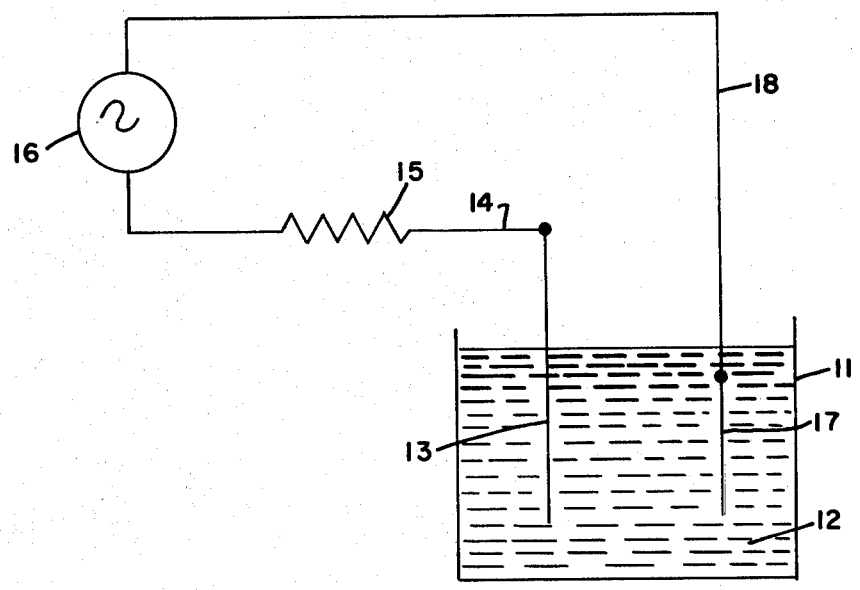
16
15
14
18
11
17
13
12

TUNGSTEN-QUARTZ SEALS

TECHNICAL FIELD

This invention relates to glass-to-metal sealing and more particularly to tungsten-to-quartz sealing.

BACKGROUND ART

In the manufacture of electric lamps, such as mercury vapor lamps or metal halide lamps, which employ tungsten electrodes or lead-ins sealed in quartz arc tubes, a problem of "crazing" often causes rejects and consequent increased costs. The term "crazing" relates to cracks which form in the seal area. These cracks can weaken the seal and, in the worst case, cause loss of hermeticity. At least one cause for the "crazing" problem has been alleged to be the difference in the coefficients of thermal expansion between these two materials. The problem appears to be aggravated if the tungsten surface is smooth, such as is obtained by sinterless grinding of the tungsten.

SUMMARY OF THE INVENTION

It is, therefore, an object of the invention to obviate the disadvantages of the prior art.

It is another object of the invention to improve tungsten-to-quartz seals.

A further object of the invention is the reduction of crazing in the production of tungsten-to-quartz seals.

These objects are accomplished in one aspect of the invention, by the provision of a method for reducing cracks in hermetic seals formed between drawn, ground tungsten rod and quartz which includes the steps of electrochemically etching the tungsten rod until some of the original draw lines appear. The etched tungsten rod is subsequently consumated in a quartz seal by conventional sealing techniques.

Forming seals with tugnsten rod so treated reduces crazing and improves the seals.

BRIEF DESCRIPTION OF THE DRAWING

The single FIGURE is a diagrammatic view of one embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

In a preferred embodiment of the invention, drawn, ground tungsten rod of a character suitable for sealing in quartz is electrochemically etched until some of the original draw lines appear.

Referring to the drawing with greater particularlity, a suitable container 11 contains electrolytic solution 12 comprised of, by volume, about 10 parts water to about 1 part sodium hydroxide (NaOH). This solution is saturated with sodium nitrite ($NaNO_2$).

A carbon electrode 13 is connected, through conductor 14 and resistor 15, to one side of a power source 16; and a tungsten rod 17 is connected via conductor 18 to the other side of power source 16.

Power source can be a 60–80 V a.c. supply from, for example, a 120 a.c. variac while resistor 15 can be a 500 watt, 28 ohm unit.

Under these conditions, and with the solution 12 at room temperature, i.e., 20° C. to 25° C., etching time will be 3 to 5 seconds.

Employment of this process greatly reduces crazing and thus improves the seals in which this tungsten material is employed.

While there have been shown and described what are at present considered to be the preferred embodiments of the invention, it will be apparent to those skilled in the art that various changes and modifications can be made herein without departing from the scope of the invention as defined by the appended claims.

I claim:

1. In the method of reducing cracks in hermetic seals formed between drawn, ground tungsten rod and quartz, the improvement comprising the steps of: electrochemically etching said tungsten rod in an etching solution until some of the original draw lines appear; stopping said etching; removing said tungsten rod from said etching solution; and subsequently sealing said tungsten rod in quartz to form said hermetic seal.

2. The method of claim 1 wherein said electrochemical etching takes place in a solution of $NaNO_2$, NaOH, and $H_2O$.

3. The method of claim 2 wherein said solution comprises, by volume, about 10 parts water, about 1 part NaOH, and said solution is saturated with $NaNO_2$.

* * * * *